United States Patent [19]

Gilbert

[11] Patent Number: 4,531,479

[45] Date of Patent: Jul. 30, 1985

[54] MONITOR SYSTEM FOR VERTICAL BOILERS

[76] Inventor: Lyman F. Gilbert, 1850 S. Second Ave., Arcadia, Calif. 91106

[21] Appl. No.: 590,178

[22] Filed: Mar. 16, 1984

[51] Int. Cl.[3] ..... F22B 37/42

[52] U.S. Cl. ..... 122/504.2

[58] Field of Search ..... 122/504, 504.2, 504.1

[56] References Cited

U.S. PATENT DOCUMENTS 2,385,161 9/1945 Pinkerton ..... 122/504.2

FOREIGN PATENT DOCUMENTS 2402138 1/1974 Fed. Rep. of Germany ... 122/504.2

*Primary Examiner*—Edward G. Favors

*Attorney, Agent, or Firm*—Donald D. Mon

[57] ABSTRACT

A monitor for the boiler water level in a boiler tube extends from the upper portion of the steam drum to the lowest water drum, header, or the like, and sensors are placed along its length which are responsive to the presence or absence of liquid water at the respective elevation. The condition of the various sensors can be utilized to read out the level of water in the system. The tube can be an external equalizer tube that extends between two extreme elevations, or can be a plurality of segments each extending for only a portion of the total height.

15 Claims, 3 Drawing Figures

MONITOR SYSTEM FOR VERTICAL BOILERS

FIELD OF THE INVENTION

This application relates to determining the presence or absence of water in a water boiler system, especially as it relates to low water level in the boiler.

BACKGROUND OF THE INVENTION

Boilers classically involve the flow of water between an upper steam drum and a lower water drum or header. Steam is removed from the upper steam drum and feed water is replaced therein to flow downwardly, as cooler water through a conduit conventionally known as a downcomer to the water drum or header. Water from the lower drum or header rises to the steam drum through risers which are conventional boiler tubes that are heated in the radiant or convection section of a boiler. Steam is generated in these riser tubes. The steam is separated from the water in the steam drum.

Boilers of this class are frequently very large, and of considerable height, such as ten to twelve stories high. They have very hot combustion chambers. Some have chemicals in the furnace. If water contacts the chemicals, steam will instantly be generated at great pressure, and can cause disastrous explosions. A classical source of such water is the rupture of one of the riser (boiler) tubes which releases water into the combustion chamber.

This anticipated risk is guarded against by rather elaborate systems for dumping water (rapid draining) from the system as quickly as possible after the detection of a leak. A conventional technique is to actuate a plurality of dump valves, each of a very large size. During the rapid drain of the boiler the operating personnel have no indication of the water level remaining in the boiler. Many people have been killed while trying to examine the furnace in which a tube was leaking water into the furnace. A furnace explosion occurred while they were peering into the furnace.

For example, suppose that the dump system relies for its indication upon the fact that the shaft of a dump valve has been turned as verification that the water has in fact been dumped. This does not preclude the condition that perhaps the valve shaft has sheared off, or that the outlet pipes are plugged or a block valve is inadvertently left closed. In these cases, the draining process will be slower, thus permitting more water to enter the combustion chamber. Thus in the absence of an absolute assurance that all of the water in the system has been dumped, a person should not expose himself to the risk of investigation. Instead, he should stay in the safety of the block-house control room until the situation has resolved itself. Unfortunately, this resolution can involve very serious damage to the boiler, which might have been avoided had there been proper knowledge of the actual condition of the water level in the boiler system.

It is an object of this invention to provide an elegantly simple, reliable, and in its best embodiment, a passive system for providing information regarding the status of the water level in the boiler over its entire height. The system operates under normal conditions and emergency conditions.

BRIEF DESCRIPTION OF THE INVENTION

This invention is carried out in the water circuit of the boiler. The system works equally well on all types of boilers, including those types having a steam drum with an upper region normally occupied by steam and water, and a water drum or header normally filled only with water. A downcomer conduit extends between the lower region of the steam drum and the water drum, and a riser conduit (boiler tube) extends between the water drum and the steam drum. An equalizer tube extends as a conduit between the upper region in the steam drum and the water drum. A plurality of sensor means is disposed along the equalizer tube at a plurality of respective elevations, the sensors being respective to the presence or absence of liquid water. Display means displays the condition of said sensors, thereby to indicate the level of water in the system.

According to a preferred but optional feature of the invention, the sensors are passive in the sense that they require no moving parts. The preferred embodiment is an electrode gap, between whose points an electrical current will be conducted when both points are immersed in water that has even a miniscule mineral content. In the absence of such water, i.e.—in the presence of steam vapor, insufficient or no current will flow from one point to the other to cause the electronic circuit to respond.

The above and other features of this invention will be fully understood from the following detailed description and the accompanying drawings in which:

DETAILED DESCRIPTION OF THE INVENTION

Figure 1:
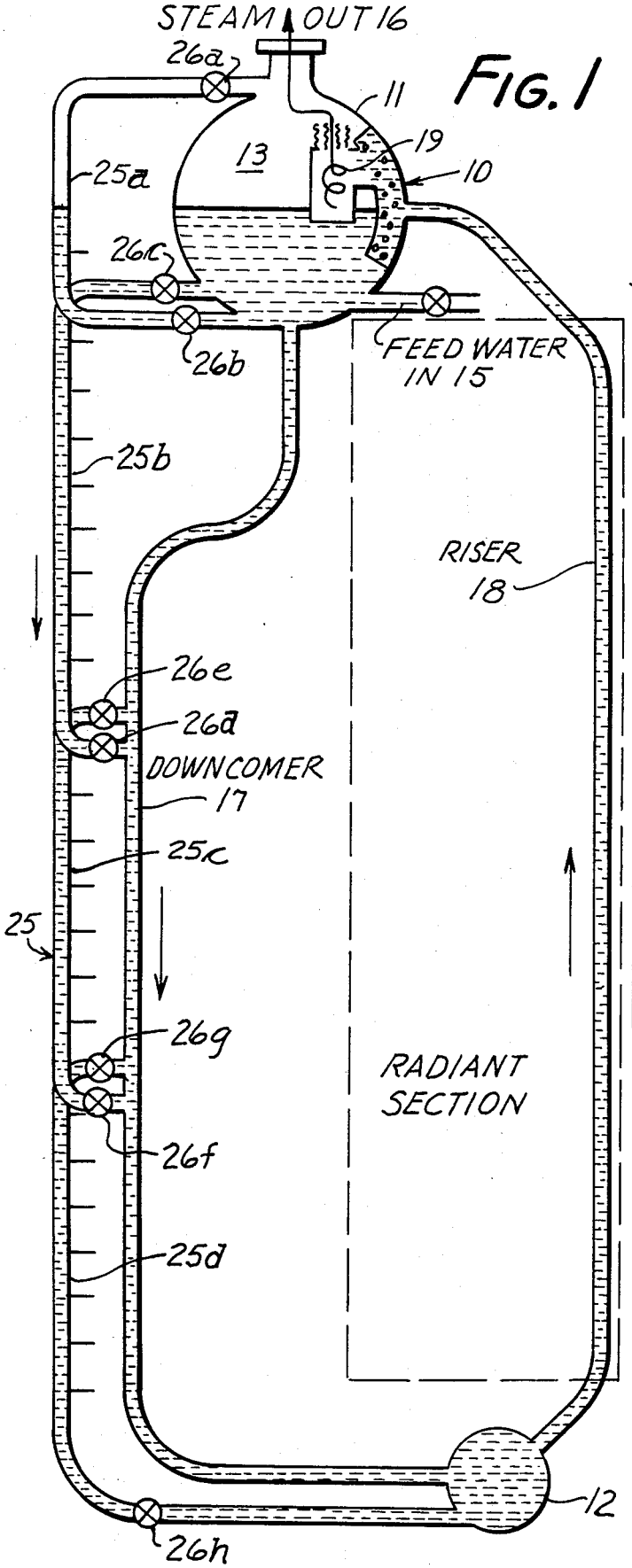
FIG. 1 is a schematic illustration of a boiler circuit incorporating the invention.

In FIG. 1 there is a shown a schematic illustration of a water circulation system 10 such as is customarily used in large boilers. There is an upper steam drum 11 and a lower water drum 12. The lower water drum is kept full of water, while the upper steam drum has an upper region 13 normally occupied by steam, and a lower region normally occupied by water. Feed water inlet 15 supplies feed water to the steam drum, and a steam outlet 16 at the top of the steam drum withdraws steam which is then separated from the mixture of water and steam which is returned to it from the boiler.

A conduit commonly called a downcomer 17 extends between the lower region of the steam drum and the water drum. A riser 18 extends between the water drum and the steam drum. Classically, its outlet stream passes through a steam separator 19 in the steam drum, the details of which are not pertinent to this invention.

Water in the downcomer is relatively cool and flows downwardly toward the water drum. Water in the riser is heated and generally flows upwardly, thereby establishing a circulation pattern which may or may not be assisted by pumping means. There are of course a plurality of downcomers and risers sufficient to supply the needs of the boiler. Of most importance to this invention is that the risers are placed inside the radiant section of the combustion chamber (not shown) of a boiler.

Leakage from these risers such as from a ruptured tube is a matter of extreme danger, and should it occur then it is necessary immediately to dump the water from this entire system by means of a plurality of dump valves or other means. These means are not shown, they are not pertinent to this invention.

Suffice it to say that the grave danger resulting from such leakage must be avoided at all costs. There exist today numerous means for attempting to do this, but none has the simplicity and reliability of this invention. For this purpose, the invention provides an equalizing tube 25 which extends between the upper region of the steam drum, preferably at its top, down to the water drum. It extends downwardly to encompass any elevation wherein there is danger of a flow of water into the combustion chamber. Thus the equalizing tube should extend from the steam drum down to the level at which water remaining in the system no longer poses a risk to the installation.

The level of water in the equalizing tube will of course indicate the level of water in the system and will be a definitive and reliable indication of the level of water in the system. It is not dependent upon responses from devices which are intended to control or establish some condition such as a dump valve in the system.

It is of course possible to make the equalizing tube transparent and visible, and to observe it directly, but this requires that someone be present to view it, which would subject them to unnecessary risk. It also involves the inconvenience and uncertainty of human presence and observation. Instead, a plurality of sensors 30 are placed along the equalizing tube so as to be responsive to the presence or absence of water at their respective levels.

Feed water supplied to boilers is maintained of great purity because the evaporation processes which take place will soon build up substantial mineral content no matter how pure is the water, because 100% purity is not feasible. Therefore there will be sufficient electrolytic conduitivity in the water to conduct an electric current. While this device utilizes the conductivity of the water as a means to discriminate between the presence or absence of water at a given elevation, it is to be understood that any sensor technique which is responsive to the presence or absence of water will be useful herein. For example, instead of conductivity, optical properties may be utilized instead.

Figure 2:
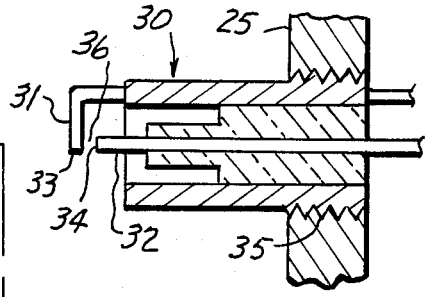
FIG. 2 is a schematic illustration of the preferred embodiment of a sensor for this invention.

It is to be preferred that the sensor be passive in the sense that it has no moving parts, because moving parts themselves can be troublesome. Still, sensors with moving parts such as floats and the like are within the scope of this invention. Perhaps the simplest, and definitely the best known, embodiment of such a sensor at the present time is shown in FIG. 2, wherein a sensor 30 is shown with a pair of electrodes 31, 32 terminating in spaced-apart points 33, 34. The electrodes pass through an insulated base 35 which is threaded into the wall of the equalizing tube.

The electrodes are provided with means for the connection of leads to these electrodes, and it will be understood that conduction of electricity between the points across electrode gap 36 will be impossible in the absence of water, and possible when water with sufficient mineral content bridges the two points. This is at once a simple and reliable sensor for the intended purpose. In some small boilers it is practical to mount the electrodes in the shell of the boiler, thus eliminating the need for the equalizing tube. Certain manufacturers of boilers provide large downcomers with low fluid velocity so that it is practical to install the electrodes in the downcomer. These are more the exception than the rule.

Figure 3:
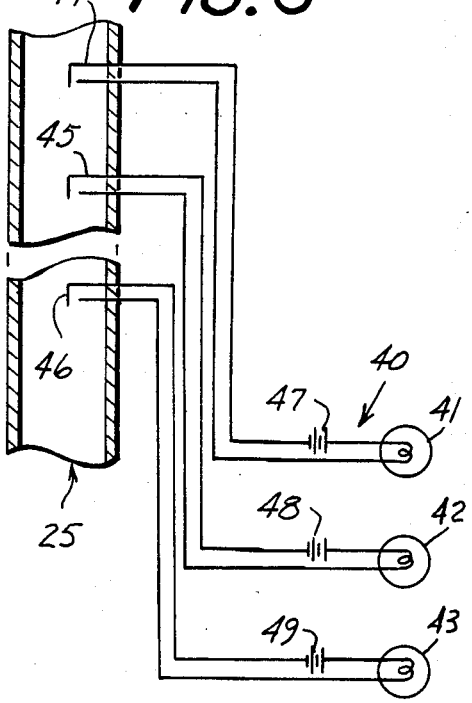
FIG. 3 is a simplified embodiment of a useful readout system.

It is not enough as a practical matter simply to provide a group of sensors, but instead there should be provided to the operator a simple visual indication of the water level in the system. Such arrangement is shown in FIG. 3, wherein, in an array 40 of lamps 41, 42, 43, the lamps are respectively connected to sensors 44, 45, 46. Each of these sensors may be coupled to a respective battery 47, 48, 49 or the source of electricity may instead be a bussbar. The level of the water will be indicated by the highest illuminated lamp in the array.

Similar arrangements can be made with the use of different classes of sensor, but in every case a plurality of sensors will be provided at respective elevations whose conditions are respective to the presence or absence of liquid water.

The equalizing tube can be made of a single continuous tube which extends from the uppermost to the lowermost elevation of intensity, and this is within the scope of the invention. However it should be kept in mind that boilers of the type which will usually use this invention are literally giant installations. They take hours or days to start up and shut down, and it is not suitable to require them to be shut down for minor maintenance. If the equalizer tube were a single, uninterrupted tube, then shut down at various elevations for localized maintenance would be impossible.

To enable localized isolation, and still to retain the active monitoring at other elevations, the equalizing tube will be constructed in segments 25*a*, 25*b*, 25*c*, 25*d*. Each preferably vertically overlap the adjacent segment, and shut-off valves 26*a*, 26*b*, 26*c*, 26*d*, 26*e*, 26*f*, 26*g* and 26*h* will be plumbed into them near their connection to the drums or downcomer.

The equalizer tube thereby extends either as one continuous tube, or as a plurality of tubes from the steam drum to the water drum, and sensors are placed in it (or directly in a downcomer acting as an equalizer tube, or in the boiler structure itself) at all critical levels. Certainly this includes all elevations wherein low water level should cause alarm or shutdown. It can also extend to all levels so as to monitor during filling and draining.

This invention thereby provides an elegant means for determining the actual condition of the water level in a boiler of this class without secondary reliance upon the condition of other controls.

This invention is not to be limited by the embodiments shown in the drawings and described in the description, which are given by way of example and not of limitation, but only in accordance with the scope of the appended claims.

I claim:

1. In a boiler circuit having water and steam, with an upper region normally occupied by steam at or above a normal water level, and a lower hazardous water level normally occupied by water, the improvement comprising: an equalizer tube extending externally of said boiler as a conduit between said upper region and said hazardous water level; a plurality of sensor means disposed along said tube at respective elevations, said sensors being responsive to the presence or absence of liquid water; a downcomer conduit conducting water between an upper and a lower elevation, said equalizer tube comprising a plurality of segments, each of which extends for less than the full height of the boiler, and in which respective isolation valves connect each of said segments to said downcomer at two different elevations, and are adjustable to isolate said segments; and display means to display the response condition of said sensors.

2. Apparatus according to claim 1 in which said display means is provided as an array illustrative of the elevation of the water in the system.

3. Apparatus according to claim 1 in which said sensors are passive in the sense of having no moving parts.

4. Apparatus according to claim 3 in which said sensors comprise conductive electrodes spaced apart from one another between which an electrical circuit can be made in the presence of liquid water with a sufficient mineral content.

5. Apparatus according to claim 4 in which said sensors are optically responsive to the presence or absence of water at the respective elevations.

6. Apparatus according to claim 1 in which means is also provided to display the condition in ways visually to illustrate the presence or absence of water at the sensor.

7. Apparatus according to claim 1 in which adjacent said segments vertically overlap one another.

8. Apparatus according to claim 1 in which said upper region is contained within a steam drum, and a water drum is connected to said tube, at an elevation beneath that of said steam drum.

9. In a boiler circuit having water and steam, with an upper region normally occupied by steam, and a lower region normally occupied by water, the improvement comprising: an equalizer tube extending as a conduit between said regions; a plurality of sensor means disposed along said equalizer tube at respective elevations, said sensors being responsive to the presence or absence of liquid water; a downcomer tube extending between said regions; and display means to display the response condition of said sensors.

10. Apparatus according to claim 9 in which said display means is provided as an array illustrative of the elevation of the water in the system.

11. Apparatus according to claim 9 in which said sensors are passive in the sense of having no moving parts.

12. Apparatus according to claim 11 in which said sensors comprise conductive electrodes spaced apart from one another between which an electrical circuit can be made in the presence of liquid water with a sufficient mineral content.

13. Apparatus according to claim 12 in which said sensors are optically responsive to the presence or absence of water at the respective elevations.

14. Apparatus according to claim 9 in which means is also provided to display the condition in ways visually to illustrate the presence or absence of water at the sensor.

15. Apparatus according to claim 9 in which said upper region is contained within a steam drum, and a water drum is connected to said tube, at an elevation beneath that of said steam drum.

* * * * *